US007168773B1

(12) United States Patent
Emary

(10) Patent No.: US 7,168,773 B1
(45) Date of Patent: Jan. 30, 2007

(54) DRAWER EXPANDER

(76) Inventor: Grant S. Emary, 5541 NW. 112th Ave., Miami, FL (US) 33178

( * ) Notice: Subject to any disclaimer, the term of this patent is extended or adjusted under 35 U.S.C. 154(b) by 212 days.

(21) Appl. No.: 10/905,821

(22) Filed: Jan. 21, 2005

(51) Int. Cl.
*A47B 88/00* (2006.01)

(52) U.S. Cl. ..... 312/246; 312/319.3; 312/330.1; 312/325

(58) Field of Classification Search ..... 312/245–248, 312/272, 273, 325, 348.4, 348.3, 294, 330.1, 312/327, 328, 205, 319.1–319.4
See application file for complete search history.

(56) References Cited

U.S. PATENT DOCUMENTS

| | | | | | |
|---|---|---|---|---|---|
| 841,813 | A | * | 1/1907 | Plummer | 190/17 |
| 876,159 | A | * | 1/1908 | Erickson | 312/248 |
| 884,428 | A | * | 4/1908 | Strong | 312/201 |
| 1,112,733 | A | * | 10/1914 | Umphrey et al. | 312/266 |
| 1,895,661 | A | * | 1/1933 | Horwitt | 221/59 |
| 1,993,885 | A | * | 3/1935 | Horwitt | 221/55 |
| 2,498,402 | A | | 2/1950 | Earle | |
| 2,667,396 | A | * | 1/1954 | Liggett | 312/248 |
| 3,001,845 | A | * | 9/1961 | Thompson | 312/272.5 |
| 3,612,635 | A | * | 10/1971 | Uyeda et al. | 312/272 |
| 3,758,977 | A | | 9/1973 | Miller | |
| 3,995,926 | A | | 12/1976 | Kessler, Sr. | |
| 4,173,284 | A | * | 11/1979 | March | 206/349 |
| 4,241,963 | A | | 12/1980 | Seidel | |
| 4,765,457 | A | | 8/1988 | Rayhle | |
| 4,875,747 | A | | 10/1989 | Hollenstein | |
| 5,516,202 | A | | 5/1996 | Markezin | |
| 6,832,689 | B2 | * | 12/2004 | Cho | 206/743 |

* cited by examiner

*Primary Examiner*—Janet M. Wilkens
(74) *Attorney, Agent, or Firm*—Donald R. Schoonover

(57) ABSTRACT

A drawer expander that includes a plurality of trays that are stacked on top of each other. Spring-biased arms connect the trays together so that the trays will open when the drawer is opened and close when the drawer is closed. One form of the drawer expander can be used in a drawer, and another form can be attached to the bottom surface of a support element so the expanding trays can act like drawers that expand when opened.

3 Claims, 3 Drawing Sheets

DRAWER EXPANDER

BACKGROUND OF THE INVENTION

The present invention relates to the general art of supports, and to the particular field of cabinet structure with movable components.

Many people have a severe shortage of storage space. This most often occurs as a shortage of drawer space. Many drawers are jammed with items, and often resemble Fibber Magee's closets. Some items become lost even though they are where they should be.

Therefore, there is a need for a means for improving the storage capacity associated with most household storage devices.

Furthermore, while the inventor is aware of many drawers that have dividers and the like, such dividers have many shortcomings. For example, an item may become displaced in the divided drawer and inadvertently moved from one area to another thereby cluttering the second area.

Therefore, there is a need for a means for dividing a drawer such that items in one area are not likely to move into other areas of the drawer.

Furthermore, such drawer dividers generally do not increase the storage capacity of a drawer, they merely divide the drawer. In fact, such dividers may even decrease the storage capacity of a drawer because the divider, itself, takes up space.

Therefore, there is a need for a means for dividing a drawer in a manner that increases the storage capacity of the drawer.

PRINCIPAL OBJECTS OF THE INVENTION

It is a main object of the present invention to provide a means for improving the storage capacity associated with most household storage devices.

It is another object of the present invention to provide a means for dividing a drawer such that items in one area are not likely to move into other areas of the drawer.

It is another object of the present invention to provide a means for dividing a drawer in a manner that increases the storage capacity of the drawer.

SUMMARY OF THE INVENTION

These, and other, objects are achieved by a drawer expander that includes a plurality of trays that are stacked on top of each other. Spring-biased arms connect the trays together so that the trays will open when the drawer is opened and close when the drawer is closed. One form of the drawer expander can be used in a drawer, and another form can be attached to the bottom surface of a support element so the expanding trays can act like drawers that expand when opened.

Using the drawer expander embodying the present invention will permit the storage capacity of a drawer to be expanded yet will keep stored items organized.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 1:
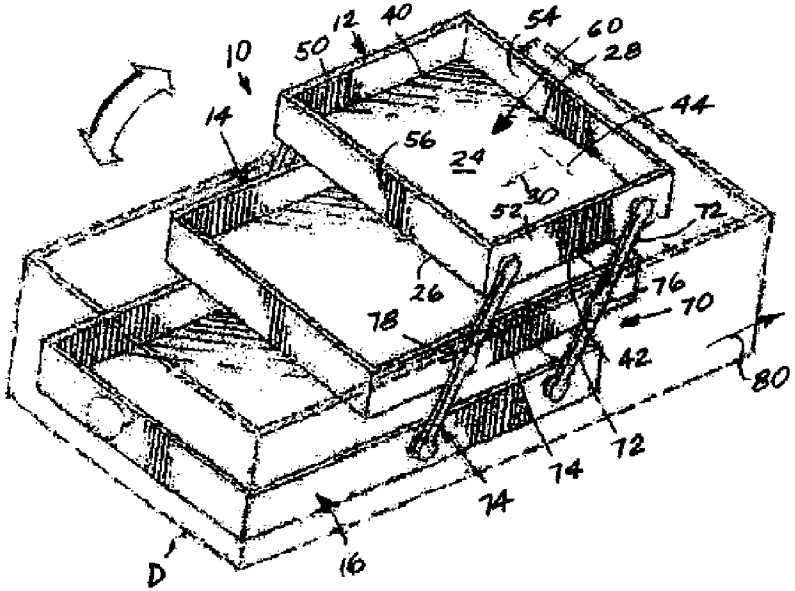
FIG. 1 is a perspective view of a first form of a drawer expander embodying the present invention.
Figure 2:
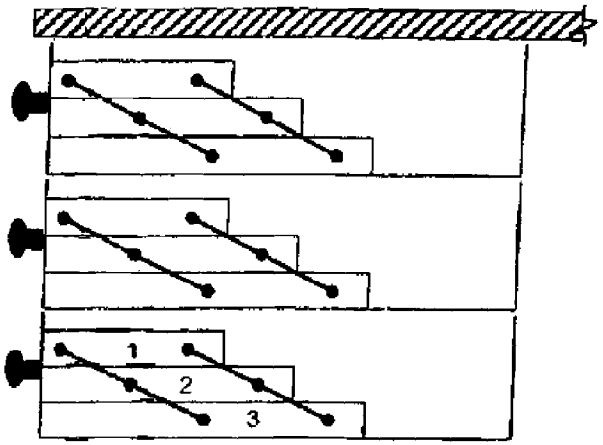
FIG. 2 is a side elevational view of three drawer expanders such as shown in FIG. 1 in closed conditions.
Figure 3:
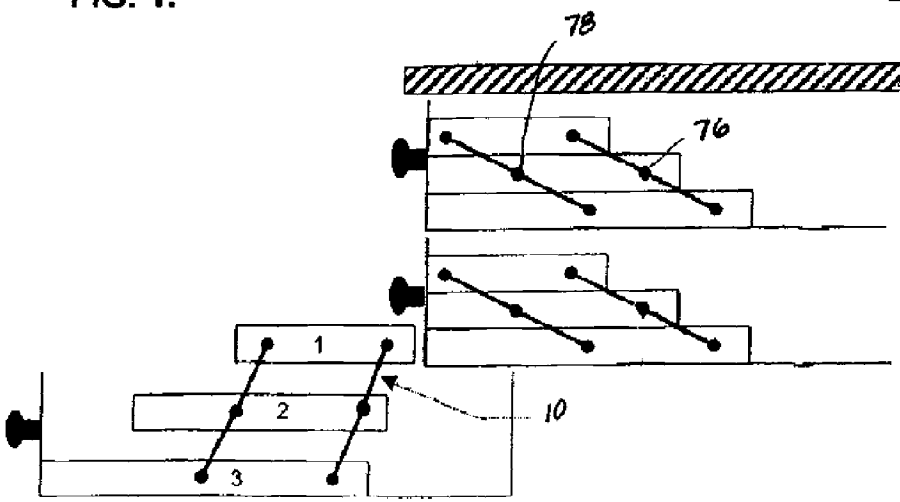
FIG. 3 is a side elevational view of three drawer expanders such as shown in FIG. 1 with one of the drawer expanders in an open condition.

Referring to the Figures, and particularly FIGS. 1–3, it can be understood that the present invention is embodied in a drawer expander 10 which achieves the above-stated objectives.

Drawer expander 10 comprises a plurality of tray units 12, 14 and 16. The tray units are in stacked configuration with one tray unit being located above an adjacent tray unit. The tray units increase in size from bottom tray unit 16 to top tray unit 12.

Other than size, the tray units are identical. Each tray unit includes a planar surface, such as planar surface 24 of tray unit 12, a first end, such as end 26 of tray unit 12 which is a front end when the tray units are in use, a second end, such as end 28 of tray unit 12 which is a rear end when the tray units are in use, and a longitudinal axis, such as longitudinal axis 30 of tray unit 12 which extends between the first end 26 and the second end 28, a first side, such as first side 40 of tray unit 12, a second side, such as second side 42 of tray unit 12 and a transverse axis, such as transverse axis 44 of tray unit 12 which extends between the first side 40 and the second side 42.

Each tray unit further includes a first side wall, such as first side wall 50 on tray unit 12, on the first side of the planar surface 24, the first side wall extending perpendicular to the planar surface 24. Each tray unit further includes a second side wall, such as second side wall 52 of tray unit 12 on the second side of the planar surface 24, the second side wall extending perpendicular to the planar surface 24, a first end wall, such as first end wall 54 on tray unit 12 on the first end 26 of the planar surface 24, the first end wall 54 extending perpendicular to the planar surface 24, and a second end wall, such as second end wall 56 of tray unit 12 on the second end 28 of the planar surface 24, the second end wall 56 extending perpendicular to the planar surface 24.

The end walls 54, 56 and planar surface 24 of each tray unit define a storage area, such as storage area 60 of tray unit 12 in which items can be stored.

A tray unit-connecting unit 70 movably connects each tray to an adjacent tray so the tray units can move with respect to each other as indicated in FIGS. 2 and 3.

The tray unit-connecting unit 70 includes a plurality of first connecting arms 72 and a plurality of second connecting arms 74.

A first spring-biased pivot connection, such as spring-biased connection 76, connects each of the first connecting arms 72 to an associated tray. A second spring-biased pivot connection such as spring-biased pivot connection 78, connects each of the second connecting arms 74 to an associated tray. The spring-biased pivot connections 76, 78 can include coil springs such as those known to those skilled in the art. Each spring-biased pivot connection 76, 78 biases the tray to which it is connected in a direction toward the second end walls 56 of the trays such as indicated by arrow 80 in FIG. 1. This biasing direction tends to close the tray units when a storage condition is desired.

At least one tray unit, such as tray unit 16, of the plurality of tray units is connected to a support member. One such support member is a drawer D. When drawer D is opened, i.e., when the drawer is moved in a direction opposite to direction 80, the tray units are opened through the action of the connecting arms 72, 74 such as indicated in FIG. 3. The bias of the pivot connections 76, 78 causes the tray units to resume their stacked configuration when the drawer is closed. The bias of the springs associated with the pivot connections 76, 78 is also selected so the individual trays can be pulled out one by one with drawer 3 in FIG. 3 drawing out drawer 2, which in turn, draws out drawer 1. Otherwise, the entire unit can be pulled out and the individual trays moved manually to expose the contents of the trays once the entire unit is drawn out.

As can be understood from FIGS. 2 and 3, each of several drawers can have a drawer expander associated therewith.

Figure 4:
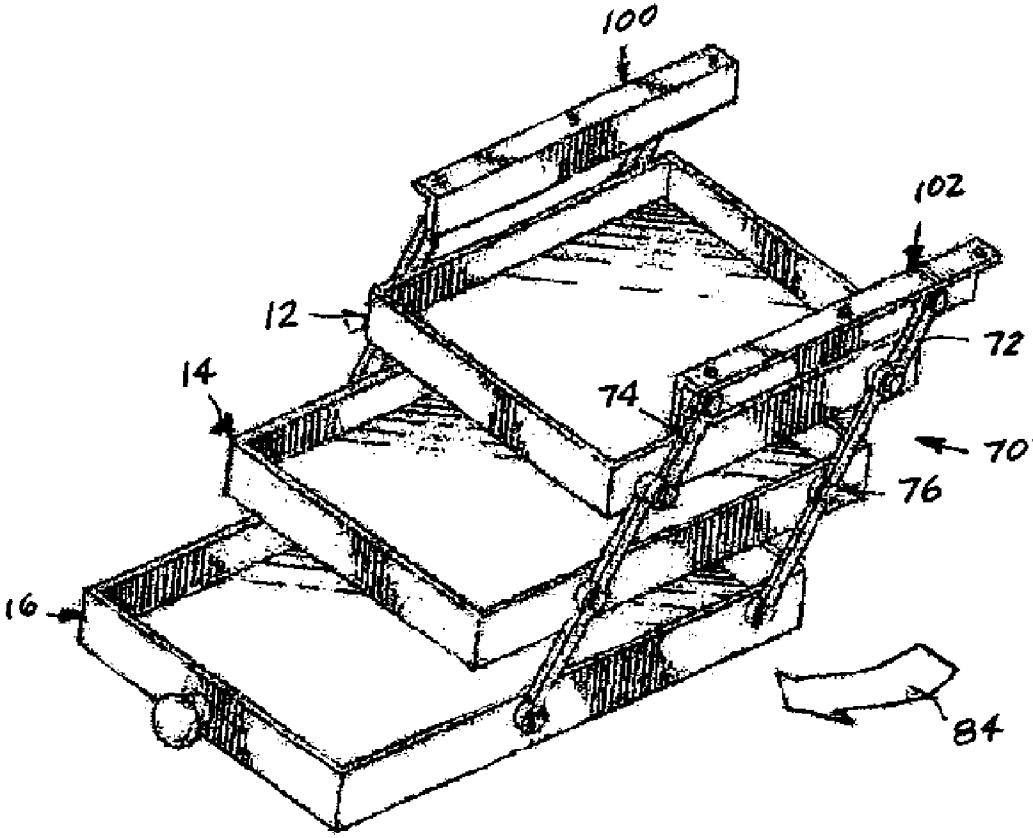
FIG. 4 is a perspective view of a second form of a drawer expander embodying the present invention.
Figure 5:
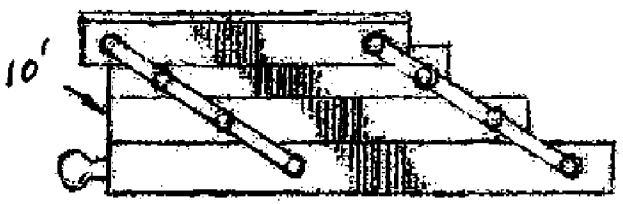
FIG. 5 is a side elevational view of the FIG. 4 drawer expander in a closed condition.
Figure 6:
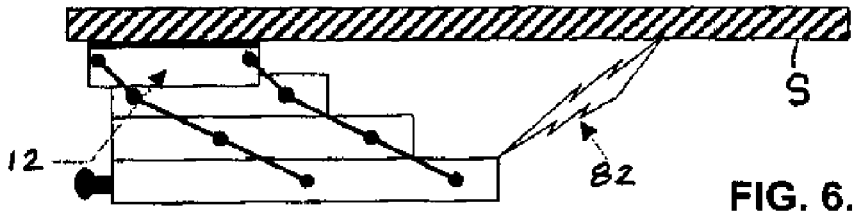
FIG. 6 is a side elevational view of the FIG. 4 drawer expander in a closed condition and attached to a support surface.
Figure 7:
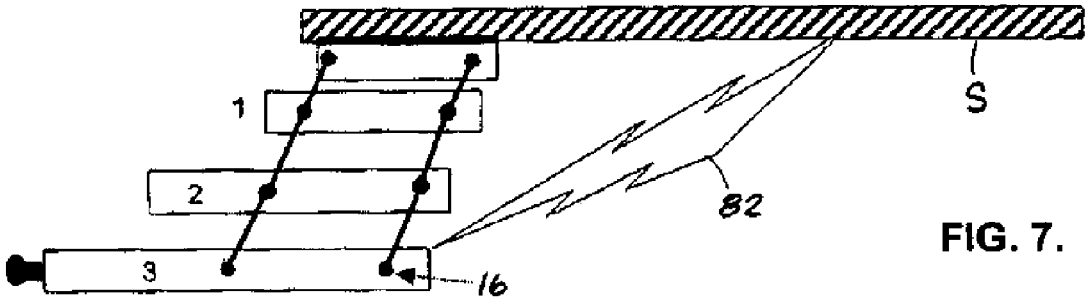
FIG. 7 is a side elevational view of the FIG. 4 drawer expander in an open condition.
Figure 8:
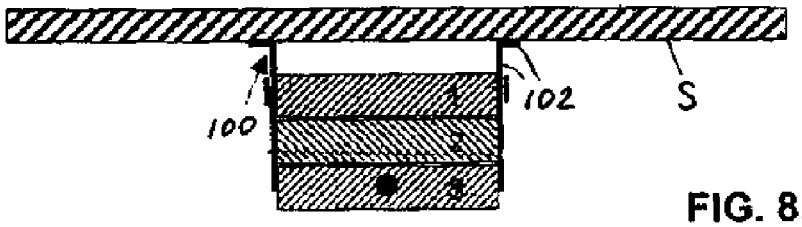
FIG. 8 is a front elevational view of the FIG. 4 drawer expander in a closed condition.
Figure 9:
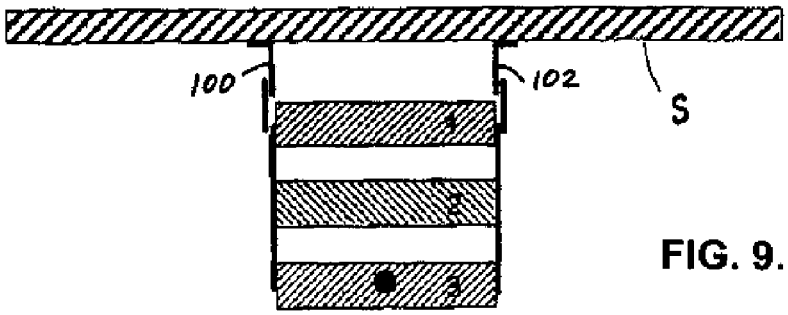
FIG. 9 is a front elevational view of the FIG. 4 drawer expander in an open condition.

A second form of the drawer expander embodying the present invention is indicated in FIGS. 4–9 and is indicated as drawer expander 10'. Drawer expander 10' is identical to drawer expander 10 with the exception of the support member being a horizontal surface S such as the bottom surface of a desk top, counter, or the like. Drawer expander 10' has a connecting unit 70' which includes two L-shaped bracket arms 100 and 102. Each bracket arm 100, 102 is fixedly mounted on the horizontal surface and one of the first connecting arms 72 and one of the second connecting arms 74 are connected to each bracket arm 100, 102. The spring bias is indicated in FIGS. 6 and 7 as bias 82 and the direction of opening movement is indicated in FIG. 4 as direction 84.

Drawer expander 10' operates identically to drawer expander 10, and thus operation of drawer expander 10 will not be discussed in detail.

It is to be understood that while certain forms of the present invention have been illustrated and described herein, it is not to be limited to the specific forms or arrangements of parts described and shown.

What is claimed is:

1. A drawer expander comprising:

(a) a plurality of tray units, each tray unit including (1) a planar surface having a first end which is a front end when said tray units are in use, a second end which is a rear end when said tray units are in use, a longitudinal axis which extends between the first end and the second end, a first side, a second side, a transverse axis which extends between the first side and the second side, (2) a first side wall on the first side of the planar surface, the first side wall extending perpendicular to the planar surface, (3) a second side wall on the second side of the planar surface, the second side wall extending perpendicular to the planar surface, (4) a first end wall on the first end of the planar surface, the first end wall extending perpendicular to the planar surface, and (5) a second end wall on the second end of the planar surface, the second end wall extending perpendicular to the planar surface;

(b) each tray unit of said plurality of tray units being oriented in a stacked configuration with each tray unit of said plurality of tray units being larger than a superadjacent tray unit;

(c) a tray unit connecting unit which includes (1) a plurality of first connecting arms, (2) a plurality of second connecting arms, (3) a first spring-biased pivot connection connecting each of the first connecting arms to an associated tray, (4) a second spring-biased pivot connection connecting each of the second connecting arms to an associated tray, (5) each spring-biased pivot connection biasing the tray to which it is connected in a direction toward the second end walls of the trays; and (d) at least one tray unit of said plurality of tray units being connected to a support member.

2. The drawer expander as described in claim 1 wherein the support member is a drawer.

3. The drawer expander as described in claim 1 wherein the support member is a horizontal surface, and said tray unit connecting unit further includes two L-shaped bracket arms, with each bracket arm being fixedly mounted on the horizontal surface and one of the first connecting arms and one of the second connecting arms are connected to each bracket arm.

* * * * *